US006652429B2

(12) United States Patent
Bushnell

(10) Patent No.: US 6,652,429 B2
(45) Date of Patent: Nov. 25, 2003

(54) EXERCISE MACHINE WITH CONTROLLABLE RESISTANCE

(75) Inventor: Raymond B. Bushnell, Beaver Creek, OR (US)

(73) Assignee: Nautilus, Inc., Vancouver, WA (US)

( * ) Notice: Subject to any disclaimer, the term of this patent is extended or adjusted under 35 U.S.C. 154(b) by 45 days.

(21) Appl. No.: 09/919,691

(22) Filed: Jul. 31, 2001

(65) Prior Publication Data

US 2003/0027693 A1 Feb. 6, 2003

(51) Int. Cl.[7] ..... A63B 21/05
(52) U.S. Cl. ..... 482/128; 482/129; 482/137
(58) Field of Search ..... 482/92, 99, 100, 482/121–123, 127–130, 111–113, 135–137

(56) References Cited

U.S. PATENT DOCUMENTS

| | | | | | |
|---|---|---|---|---|---|
| 1,547,268 | A | | 7/1925 | Sotomayor | |
| 3,638,941 | A | | 2/1972 | Kulkens | |
| 4,231,568 | A | * | 11/1980 | Riley et al. | 482/130 |
| 4,426,077 | A | | 1/1984 | Becker | |
| 4,632,390 | A | | 12/1986 | Richey | |
| 4,643,420 | A | * | 2/1987 | Riley et al. | 482/130 |
| 4,743,011 | A | | 5/1988 | Coffey | |
| 4,796,881 | A | * | 1/1989 | Watterson | 482/130 |
| 4,890,830 | A | | 1/1990 | Kern | |
| 4,988,095 | A | | 1/1991 | Ferrari | |
| 5,042,799 | A | * | 8/1991 | Stanley | 482/123 |
| 5,226,867 | A | * | 7/1993 | Beal | 482/127 |
| 5,316,534 | A | | 5/1994 | Dalebout | |
| 5,382,212 | A | * | 1/1995 | Davenport et al. | 482/123 |
| 5,527,245 | A | | 6/1996 | Dalebout | |
| 5,601,518 | A | * | 2/1997 | Weintraub | 482/129 |
| 5,733,229 | A | | 3/1998 | Dalebout | |
| 5,820,529 | A | * | 10/1998 | Weintraub | 482/92 |
| 5,860,894 | A | | 1/1999 | Dalebout | |
| 6,004,248 | A | * | 12/1999 | Price | 482/121 |
| 6,224,514 | B1 | * | 5/2001 | Price | 482/123 |

FOREIGN PATENT DOCUMENTS

| | | | | |
|---|---|---|---|---|
| NL | 8800024 | * | 8/1989 | 482/130 |

* cited by examiner

*Primary Examiner*—Jerome W. Donnelly
*Assistant Examiner*—Victor Hwang
(74) *Attorney, Agent, or Firm*—Dorsey & Whitney LLP

(57) ABSTRACT

An exercising machine wherein a cable pull is resisted by spring deflection. The cable is connected to a lift arm that is pivotally fixed and carries a lift roller. The lift roller abuts a pivotally mounted bar and urges pivotal movement of the bar opposed by a spring member. The connection of the cable to the pivotal lift arm, the position of the lift roller relative to the lift arm pivot, the engagement of the roller with the pivotal bar and the engagement of the spring member with the pivotal bar all involving lever advantages that can be manipulated to achieve varying shapes of resistance of the cable pull as felt by the user.

20 Claims, 11 Drawing Sheets

EXERCISE MACHINE WITH CONTROLLABLE RESISTANCE

FIELD OF THE INVENTION

This invention relates to exercise machines that simulate weight lifting wherein resistance is provided by spring action and more particularly it relates to controlling the resistance.

BACKGROUND OF THE INVENTION

Exercising one's muscles has progressed from free weights to machines where creative assembly of weights and cables enables a person to exercise most if not all of the muscles of his/her body. Athletic clubs offer as many as 20 or more different types of machines whereby a person can progress from machine to machine and direct the exercise to different muscles of different body parts. A person can readily vary the effected weight resistance by moving a pin that adds or subtracts the number of weights that produce the resistance.

Whereas athletic clubs are desirable for a substantial segment of the population, there is a demand for home exercising machines as well. It is not generally feasible for individuals to equip their home with these same machines. Such are expensive to purchase, expensive to ship due to the bulk and weight, and substantial home space has to be dedicated to machine use only.

A large dedicated space and numerous machines are quite acceptable for an athletic club as such accommodate numerous users of the machines, the users simply staggering their time of use and sequentially cycling through the different machines. Home use on the other hand is typically a single user and space and cost are important considerations. Accordingly, home use exercising machines have been developed whereby a single machine having a creative arrangement of cables and pulleys with relatively simple adjustments thereof can provide variable resistance applicable to a wide range of user muscles. The weights of the athletic club exercising machines are replaced, e.g., with spring members that provide the desired resistance for exercise but which have only a fraction of the true weight of "weights" used for the athletic club machines. Shipping costs are dramatically reduced and the machines can be more readily moved by the home owner/user, e.g., to storage or from room to room. A guest room may be convertible as desired for guest use or for exercise use as but one example. Such a machine is hereafter sometimes referred to as a universal machine.

One problem with the use of spring members to replace the "weights" is that a spring member varies in its resistance as the spring member is deflected. A pull cable acting to deflect the spring (deflect here encompassing compression, tension, bending, etc.) may require an increasing force, e.g., a force of 5–10 pounds over the first several inches of deflection, 10–15 pounds of force over the next several inches of deflection, etc. To this extent, the spring members do not equate to a free weight which requires a constant pull force over whatever length of pull is required for the particular exercise. It is accordingly an objective of the present invention to provide a universal exercise machine that utilizes a spring force versus "weights" while providing a steady resistance to a cable pull against the spring action to simulate a true "weight." Thus, the resistance that the user experiences remains constant throughout the entire range of deflection, even though the actual resistance provided by the spring member increases as greater deflection occurs. Alternatively the resistance may be "shaped," i.e., to generate an increasing resistance or decreasing resistance or combination of increasing and decreasing resistance as may be desired for a particular exercise. "Shaped" resistances refer to dynamically changing resistances that are "felt" by the user during an exercise. Each "shaped" resistance can be thought of as a resistance curve that shows the range of movement caused by the user and the corresponding "felt" amount of resistance.

BRIEF DESCRIPTION OF THE INVENTION

In the preferred embodiment, the spring action is provided by an elongate spring member. The spring member is preferably a cylinder of elastomer having the property of being resistively and resiliently compressible. The spring member is not limited to a cylinder of elastomer, and it will be understood by those skilled in the art that other types of compressible cylinders may be used, such as a conventional spring, gas spring, etc. It may be confined in a tube that permits collapse/compression and prevents bending to thereby permit axial compression only of the elastomer cylinder. It is desirable that the range of forced differential, i.e., the force required to deflect the cylinder at the start of the cable pull versus the force of cable pull at the end of the cable pull be minimized and this is accomplished by precompressing the cylinder. Thus, with the tube at full extension, the cylinder in the tube is held to the precompression load. Alternatively, the cylinder may be skewered on a rod and sandwiched between washers. Precompression can be accomplished by providing a stop at one end and a nut threaded on the other end, the nut turned to shorten the distance between the washers to thereby compress the cylinder.

The resistance of the cylinder to further compression nevertheless still varies (gets stronger) and an arrangement is provided to counter this variation. A cable extends from the user's lifting bar or rings or foot pedal or whatever that is to be moved by the user to exercise a particular set of muscles. The cable is directed through pulleys as necessary to direct the cable from an overhead position to a lift arm. The lift arm is secured at one end to a rotatable pin or axle and the other end is connected to the cable. Pulling of the cable upwardly achieves pivoting of the lift arm about the axle axis as well as rotation of the axle. Also affixed to the axle is one end of an abbreviated (relatively shorter) pivot arm having a lift roller at its distal end. The lift roller engages the under side of a formed pivotal bar spaced from the point of pivoting. The elongate collapsible tube containing the elastomer cylinder is pivotally attached at one end at a position above the pivotal bar with the opposite end extending down to and engaging the pivotal bar also spaced from the point of pivoting.

In order to pull the cable, the lift arm has to be raised producing pivoting of the axle. This produces raising of the lift roller which acts against the formed pivotal bar to pivot the formed bar about its axis which is only accomplished by compressing the tube and cylinder.

The arrangement described provides a number of variables, the most important perhaps being the arc of movement by the abbreviated pivot arm. For a given distance of cable pull, the abbreviated pivot arm is pivoted through an angular arc. For explanation purposes, assume that the lift roller and pivot arm at the start of the pull extend to a 9 o'clock position and is pivoted to a 12 o'clock position. The resistive force of the formed bar is assumed (for explanation purposes) to produce an effective force directed vertically downward. The total vertical distance that the lift roller is assumed to travel is three inches (which is also the distance the roller moves horizontally).

It will be further assumed that the total distance of cable pull to affect the 90 degree pivotal movement of the pivot arm is 42 inches, i.e., the cable pull is 14 inches for each 30 degrees of rotation of the pivot arm. During the first 14 inches of cable pull, the pivot arm is rotated 30 degrees, i.e., from the 9 o'clock position to the 10 o'clock position. Whereas only one-third of the rotation has been completed, essentially half of the vertical distance has been completed, i.e., the formed bar has been raised about one and one-half inches with one-third the pull of the cable. The remaining one and one-half inches of vertical lift is accomplished through 60 degrees rotation of the pivot arm and 28 inches of pull of the cable. Thus, the load experienced by the user tends to get smaller (due to the changing angular direction of movement of the lift roller relative to the formed bar). As previously explained, the necessary force to compress the elastomer cylinder increases throughout compression and these variables offset one another.

The above is a somewhat simplified explanation but once the concept is appreciated, it will be understood that manipulation of such factors as lever length and point of engagement of the lift roller with the formed bar and the shape of the bar itself provides the opportunity to control the variables and "shape" the applied resistance to a particular exercise selected by the user. The invention will be more fully understood and appreciated upon reference to the following detailed description of the preferred embodiment and the accompanying drawings.

DETAILED DESCRIPTION OF THE INVENTION

Figure 1:
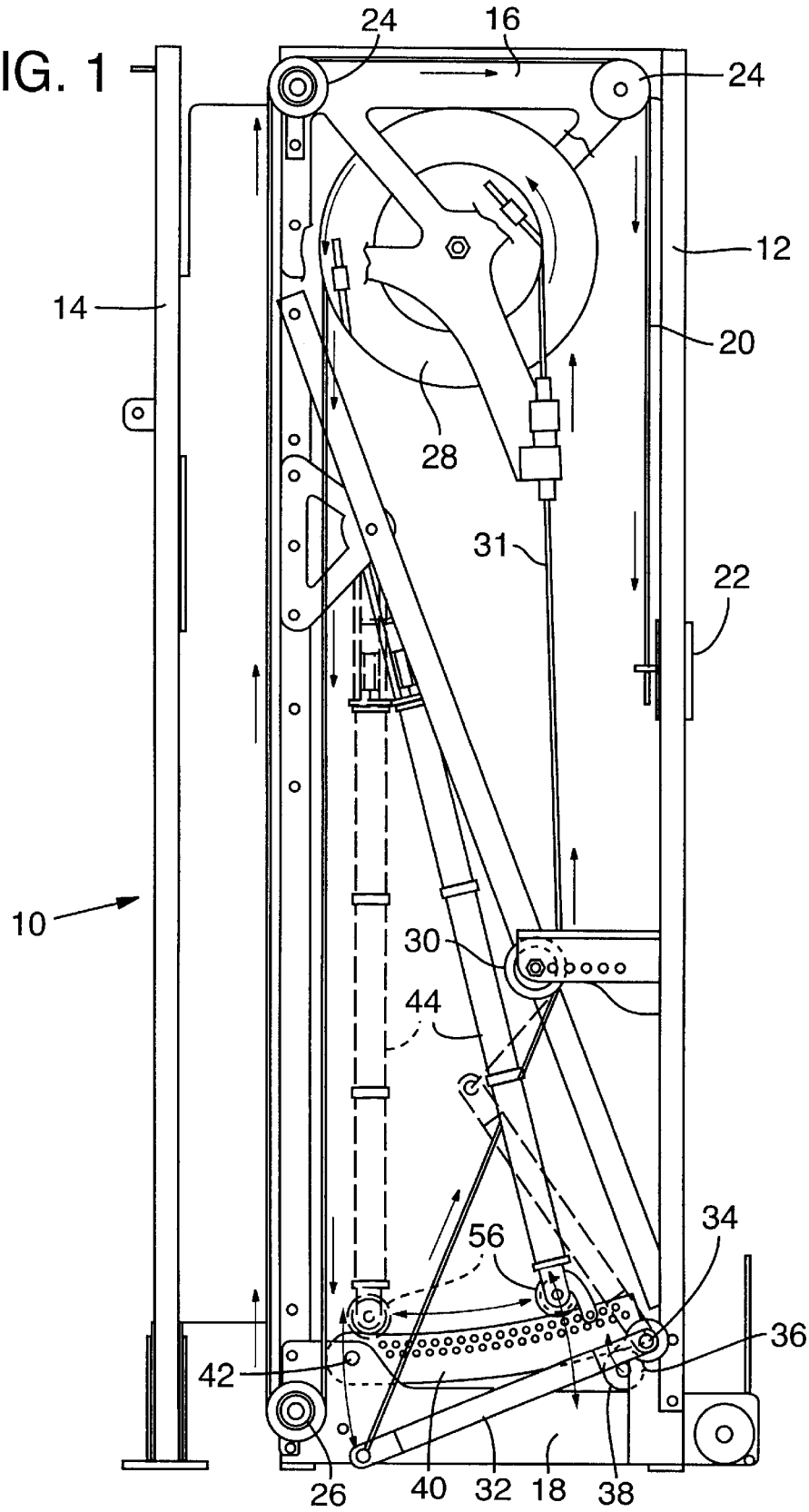
FIG. 1 is a side view of a universal exercise machine in accordance with the present invention.

FIG. 1 is a side view of a universal exercise machine in accordance with the present invention. The frame 10 of the machine is represented by front and rear struts 12, 14, respectively, and upper and lower cross braces 16, 18, respectively. What is shown is one side of the frame, the opposite side (the near side) is removed to illustrate the mechanism providing the lifting resistance supported by the frame 10 between the two sides.

A lifting cable 20 from the lifting paraphernalia (pull rings, bars, foot pads and the like) extends from guide 22 over upper pulleys 24 down to a lower pulley 26 and back up to drum 28 where the end of cable 20 is secured to the periphery of the drum and is wound onto and off of the drum as the lift cable is moved up and down through the guide 22. The details of the cable extension to the various paraphernalia is not shown. As those skilled in the art will appreciate, different arrangements of pulleys and guides are provided to direct the cable as necessary to achieve the desired resistive force, e.g., for overhead lifting, leg pushes and the number of other kinds of exercise routines common to such universal equipment.

Figure 5:
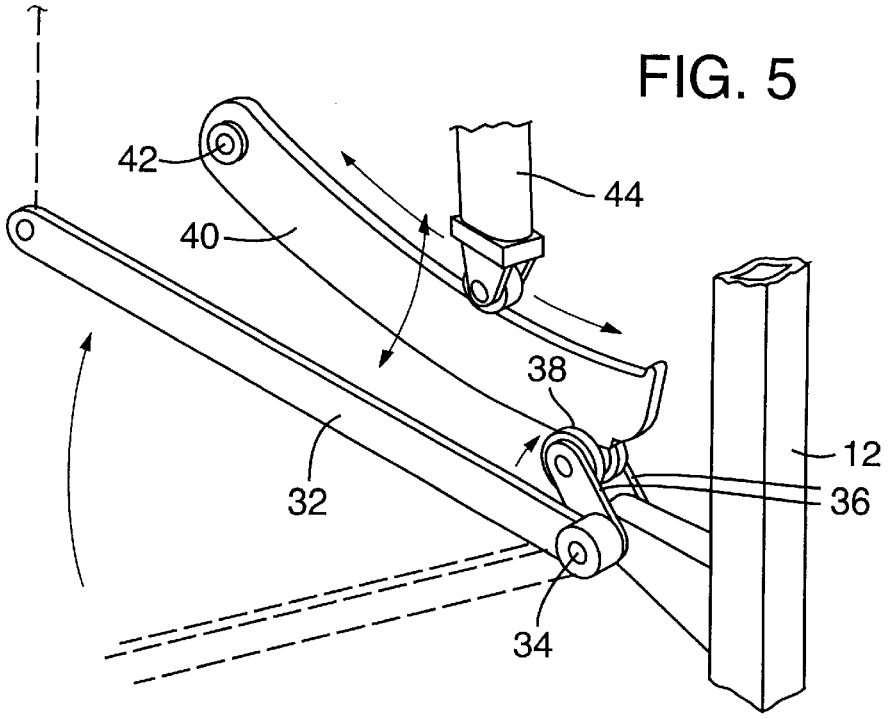
FIG. 5 is a perspective view of the working components of the machine of FIG. 1.
Figures 6, 7:
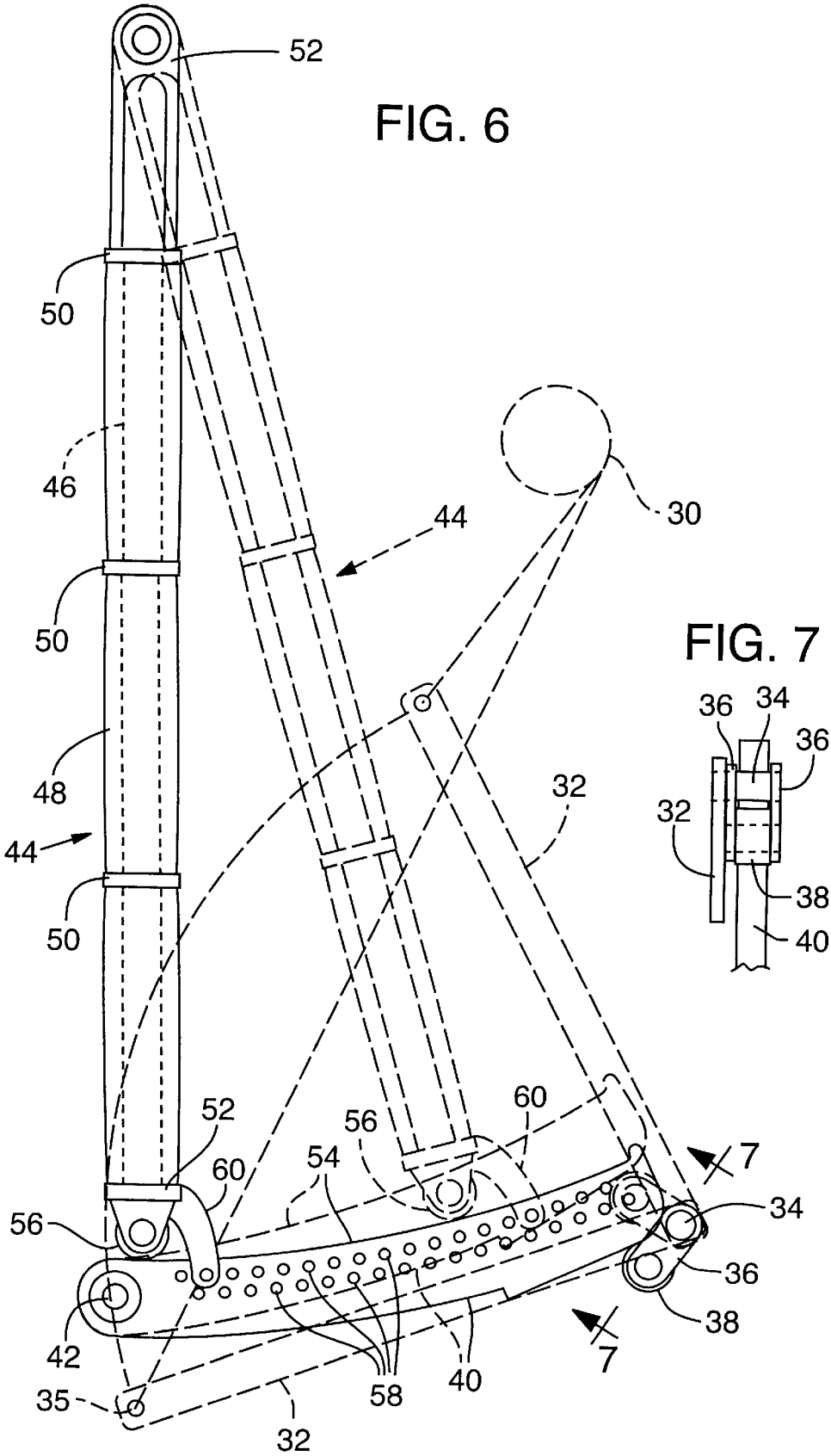
FIG. 6 is a more detailed and enlarged side view illustration of the working components of FIG. 5.
FIG. 7 is a section view as indicated by view lines 7—7 of FIG. 6.

The invention is more specifically (but not exclusively) applied to cable extension 31 that extends from an inner periphery of the drum 28, through pulley 30 and then connected to the distal end of lift arm 32. Lift arm 32 is fixedly secured to axle 34 and raising and lowering of the distal end of the lift arm 32 produces rotation of the axle 34. With reference also to FIGS. 5–7, an abbreviated pivot arm 36 is also fixed to the axle 34 and carries at its distal end a lift roller 38. Lift roller 38 engages a distal end of an elongate formed bar 40 which is pivotally connected to the frame at pivot 42. (See FIG. 1)

Overlying the elongate formed bar 40 is a spring member 44 shown best in FIG. 6. As shown, the spring member 44 includes an elastomer cylinder 46 contained and constrained in tube 48. In one version, the tube 48 is provided in sections that overlap at joints 50 and has upper and lower end caps 52. As illustrated in FIGS. 1 and 6, the tube sections are fully extended. Joints 50 are formed to allow inward telescoping of the tube sections but prevent separation of the sections. The end caps 52 are secured to the top and bottom tube sections and thus capture the elastomer inside the tube at the fully extended position while allowing inwardly directed movement to further compress the elastomer cylinder 46. Tube 48 may also be a non-collapsible tube with the cylinder being compressed within the tube. For example, the cylinder may be skewered and contained between end washers as indicated in the previous Background of the Invention.

With reference to the version of FIG. 6, the elastomer cylinder is loaded into the tube 48 under compression but as shown in FIG. 6, tube 48 is fully extended and the resilient force of the cylinder is fully contained by the tube ends 52. The cylinder 46 thus provides no force against the formed bar 40 (as shown in the solid line position of FIG. 6) which is in a relaxed position coinciding with the maximum reach of the tube 48.

In the relaxed position of FIG. 6 (solid lines) with the tube in its fully extended position and restraining the elastomer cylinder, the spring member can be pivoted to any position along the length of the bar 40, the upper side 54 of the bar 40 being curved to match the pivotal movement of the distal end of spring member 44 which is equipped with a roller 56. Movement of the end of spring member 44 adjusts the resistance to pivoting of bar 40. Accordingly, the spring member is shifted along the length of the bar 40 as desired, an example being illustrated in phantom line in FIG. 6 and in solid line in FIG. 1. At whatever position of the spring member 44 is desired, i.e., the resistance desired for a particular exercise, the position of the spring member 44 is locked in place by a lock device (latch) 60 provided on the distal end of the spring member 44 which engages a selected one of the positioning holes 58.

Refer to FIG. 6 and observe the two extreme positions of lift arm 32. Because the abbreviated pivot arm 36 and roller 38 are fixed to lift arm 32 (via axle 34), pivot arm 36 travels through the same pivoted angle but the arc of movement (the distance of travel) of roller 38 is a fraction of the arc of movement of the distal end of arm 32 (at connection 35). The distance that the cable 31 moves during such pivoting (which closely corresponds to the arc of movement of the distal end of lift arm 32) is a pre-established desired distance of movement by the lifting paraphernalia, e.g., a distance of about 42 inches as compared to a much shorter distance of movement by roller 38, e.g., about 3 inches. This movement of the roller 38 forces upward pivoting of bar 40. Bar 40 has no vertical movement at axis 42 and increasing vertical movement along the length of the bar away from the axis 42. Thus, as the spring member 44 is positioned outwardly of pivot 42 (e.g., the phantom line position in FIG. 6), the same pivotal movement of lifting arm 32 imposes increased compression of the spring member 44. This difference can be observed by noting the phantom line (raised) position of bar 40 and particularly the upper surface 54 of bar 40 (the dash line position in FIG. 6). With the spring member 44 positioned near the axis 42, very little compression is imposed on the spring member. When shifted, e.g., to the phantom line position, a much greater compression is imposed on spring member 44.

Figure 8:
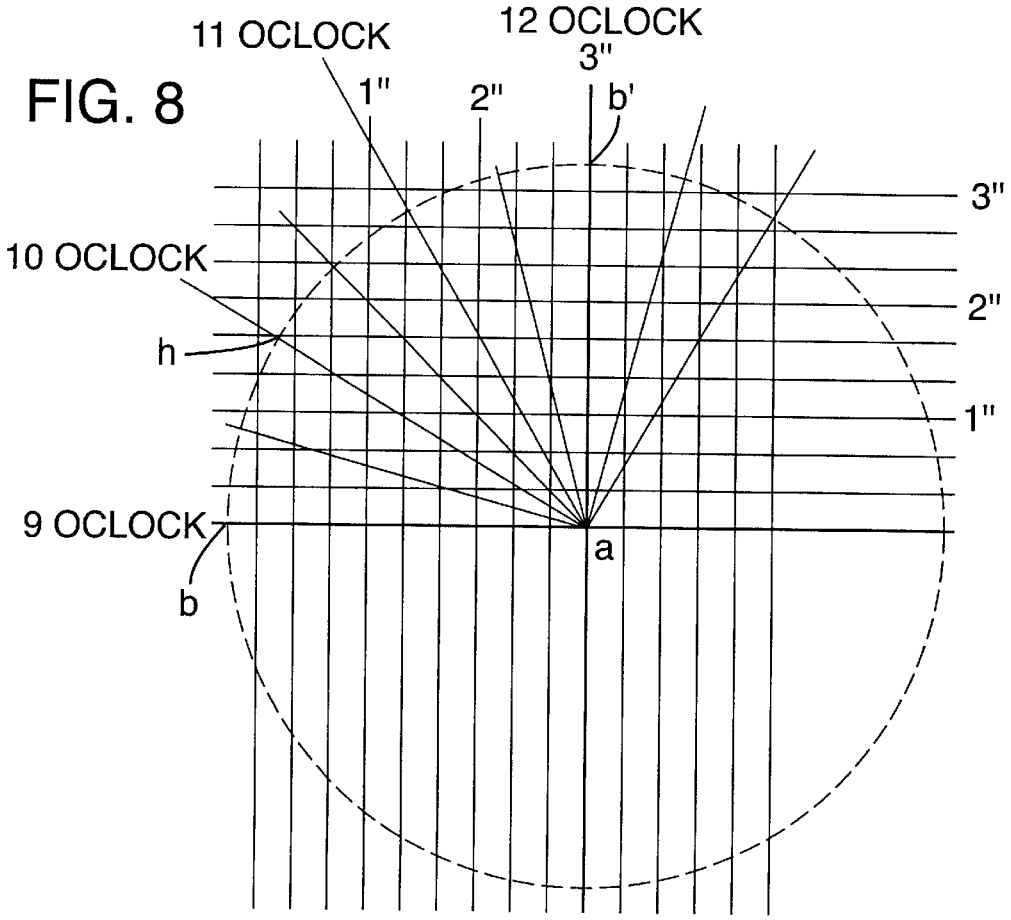
FIG. 8 is a schematic illustration of the variable effect of the pivot arm and lift roller embodied in the illustrations of FIGS. 5–7.

It will also be appreciated from FIG. 6 that arm 36 and roller 38 move through an arc of about 90 degrees as dictated by pivoting of lift arm 32. It will be observed that movement of the roller and arm through the arc changes the reach of arm 36 from a position somewhat parallel to the bar 40 (solid line position) to a position near perpendicular to bar 40 (phantom line position). Refer to FIG. 8 which illustrates the effect of such movement. The radial line a, b represents the arm and roller 36, 38 in the parallel position (the solid line position of FIG. 6) and radial line a, b' represents the arm and roller 36, 38 in the perpendicular position (the phantom line position of FIG. 6). The remaining in between radial lines represent the graduated movement of the arm between position a,b and a,b'. The horizontal grid lines illustrate vertical distance, i.e., the upward movement of bar 40 and spring member 44. Note that half the lifting distance, i.e., the one and one-half inch position (reference h) is reached during the first 30 degrees of pivoting and the remaining one and one-half inches is reached during the remaining 60 degrees of pivoting of arm 36.

Accordingly, the required pull force of the cable 31 decreases as a result of the roller moving through the arc, i.e., position b to position b'. It is also to be noted that the point of contact with the bar 40 moves as represented by the vertical lines of the grid in FIG. 8. As the roller moves from b to b', it moves a lateral distance of three inches. This three inch movement away from pivot 42 increases the lever advantage of the roller 38 relative to the selected fixed position of spring member 44. It will thus be understood that the increasing resistance of the spring member 44 is offset by (a) the changing direction of movement of the roller 38 as it moves through the arc (ab to ab') the changing point of contact of the roller on the bar which increases the lever arm advantage.

The above explains the relationship of three variables, i.e., the spring member 44 having increased resistance while being compressed, the roller 38 moving in an arc and thus in an ever changing direction relative to the direction of applied resistance, and the roller shifting outward along the bar 40 to increase the lever arm advantage. These variables can be manipulated to achieve a desired resistive force felt by the user.

Figure 2:
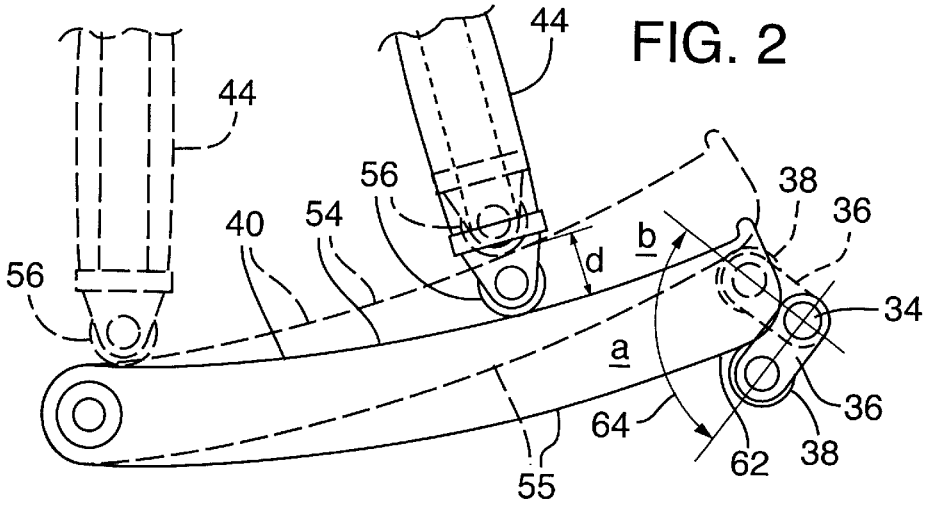
FIGS. 2–4 illustrate examples for adjusting the resistance provided for the universal exercise machine of FIG. 1.

Refer to FIG. 2 and note that throughout the lifting action (from solid line to dash line positions), roller 38 moves along segment 62 of bottom edge 55 of bar 40 to lift the bar 40 from position a to position b. During this movement and as a result of such raising of bar 40, roller 56 of spring member 44 is raised distance d (the solid line position being about two-thirds the distance between pivot 42 and the distal end of bar 40) thus compressing the cylinder 46 by distance d. Now refer to FIG. 3 and note the reconfiguration of segment 62. Roller 38 is permitted to pivot through the same arc as in FIG. 2 but without raising the bar 40 and without compressing the spring member 44. The above comparison (FIGS. 2 and 3) illustrates a further variable which is the configuration of segment 62. It is particularly important because, as will be illustrated, it permits controlled manipulation of the previously described variables. Note FIG. 4 which schematically simulates roller 38 moving along a differently shaped segment 62 where the roller travels to a mid-point position (indicated by reference m) where full upward movement of bar 40 is attained and as roller 38 continues from mid-position to full pivoting (indicated by letter f), the bar 40 is lowered.

Figure 3:
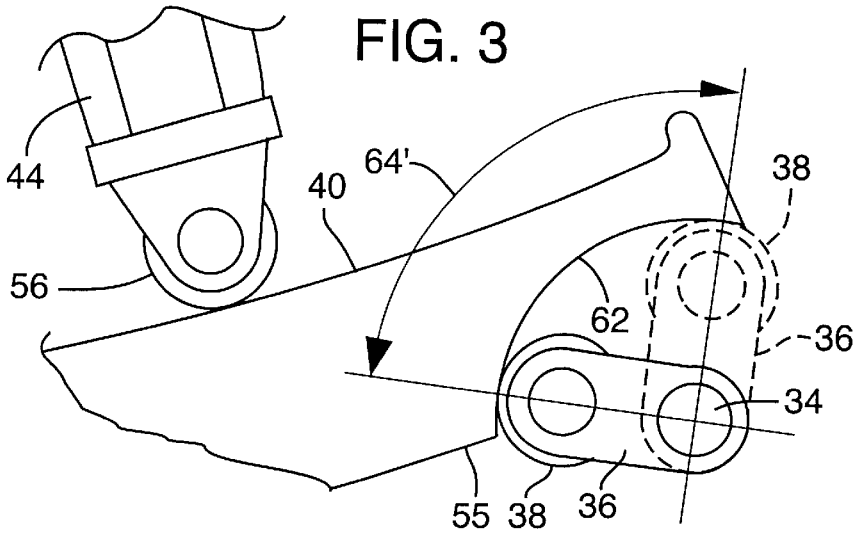
Figure 4:
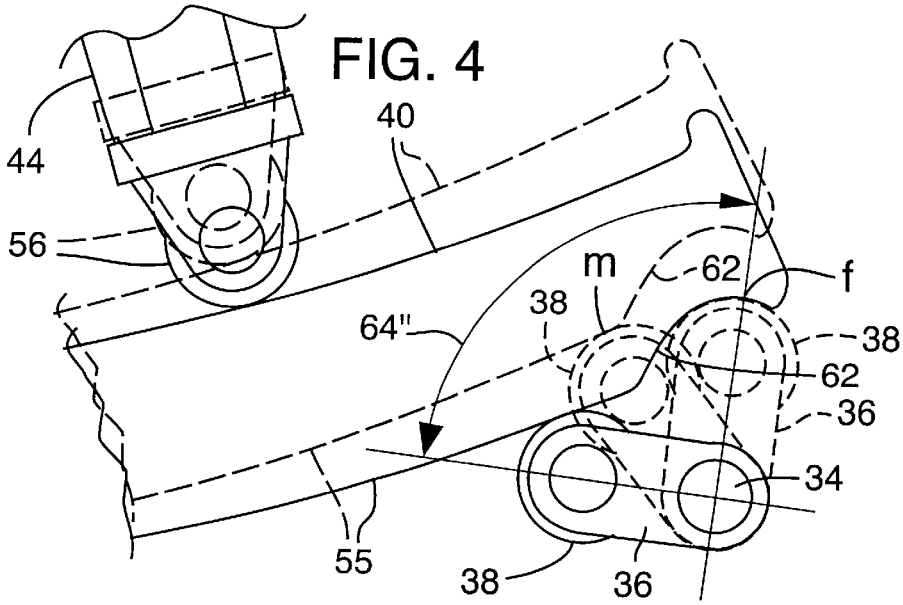

These FIGS. 2–4 are not intended to illustrate a working embodiment but rather are intended to explain the concept of how the applied force that is "felt" by the user can be manipulated. Whereas segment 62 of bar 40 can be configured so that throughout the cable pull the resistance felt by the user is constant to simulate the lifting of a true "weight," it further provides the opportunity to vary the "shape" of the resistance that is "felt" by the user.

Figure 16:
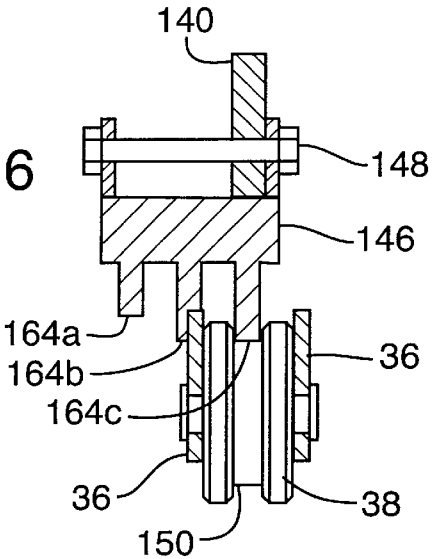
Figure 11:
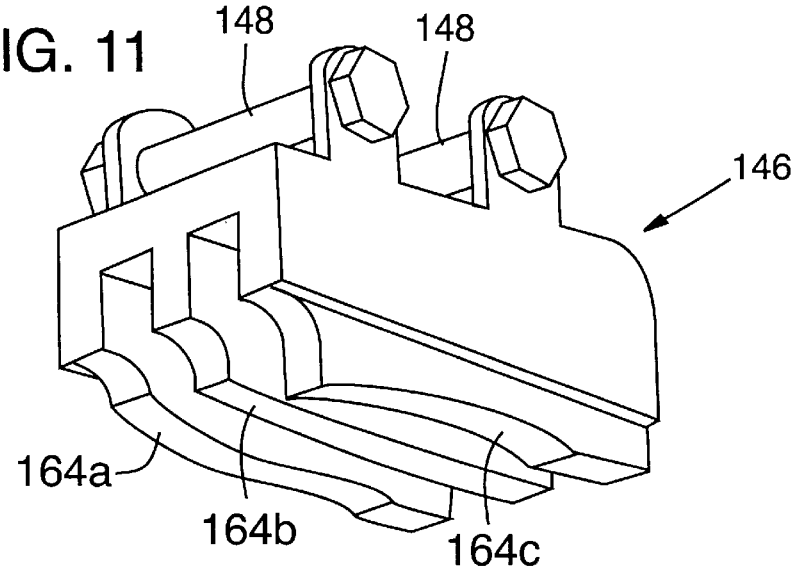
Figure 12:
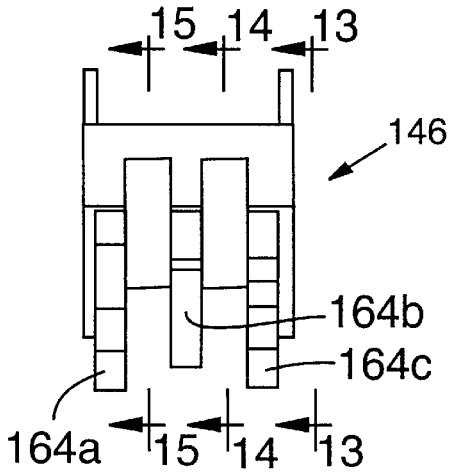
Figure 13:
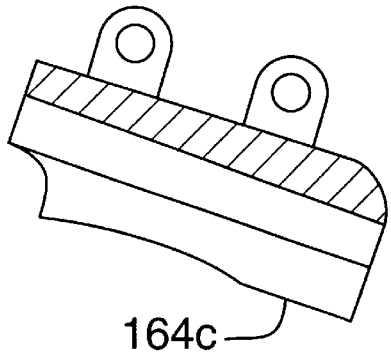
Figure 14:
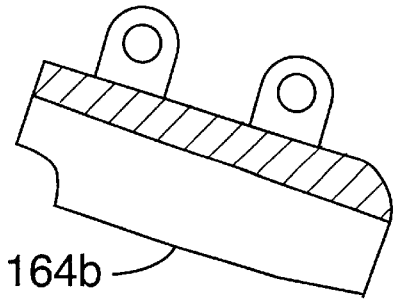

Reference is now made to FIGS. 9–17. FIG. 16 illustrates a bar 140 (corresponding to bar 40 in FIG. 6) wherein the distal end 142 of bar 140 is cut out and provided with bolt holes 144. A carriage 146 carries three different cam segments 162. Due to bolts 148 being larger than the width of bar 140, carriage 146 can be shifted laterally relative to bar 140.

Figure 9:
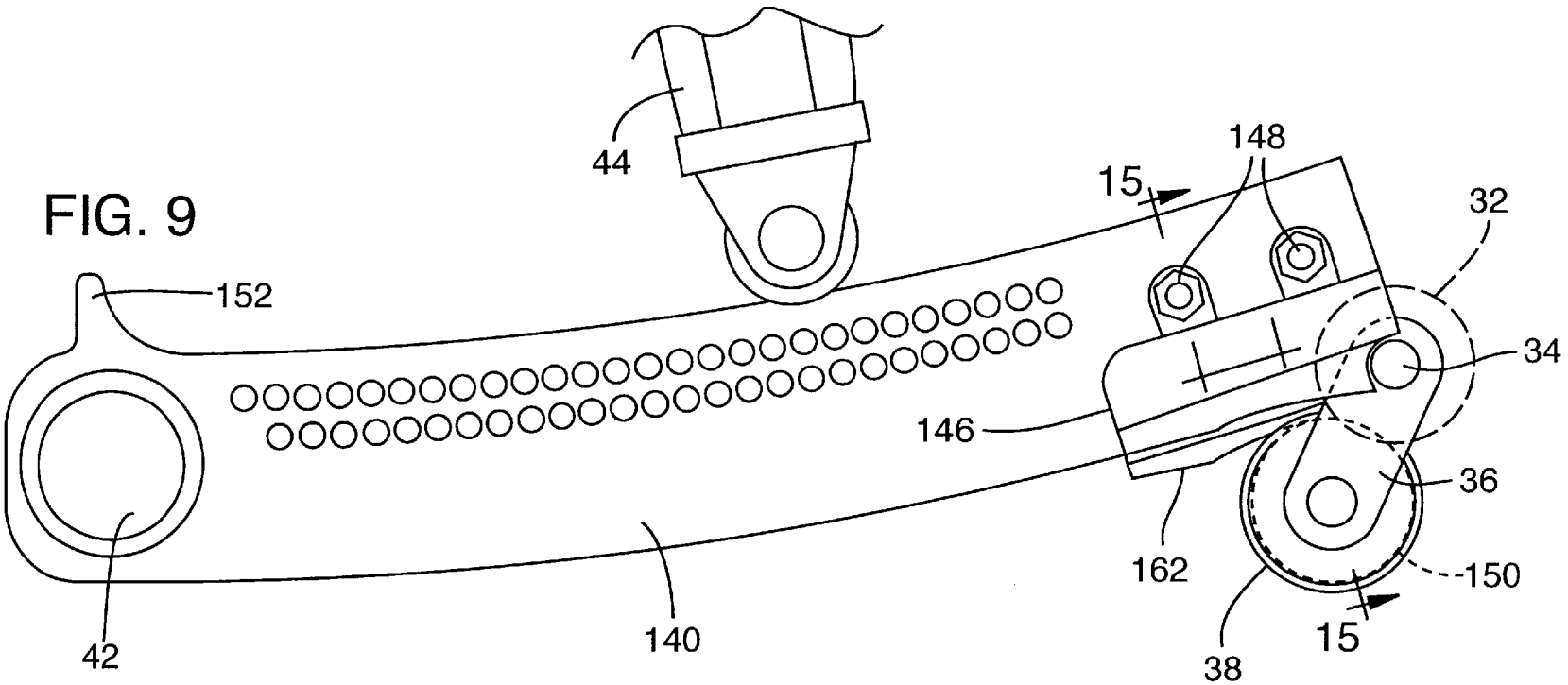
FIG. 9 is a side view of certain of the working components of an alternate embodiment of the invention.
Figure 10:
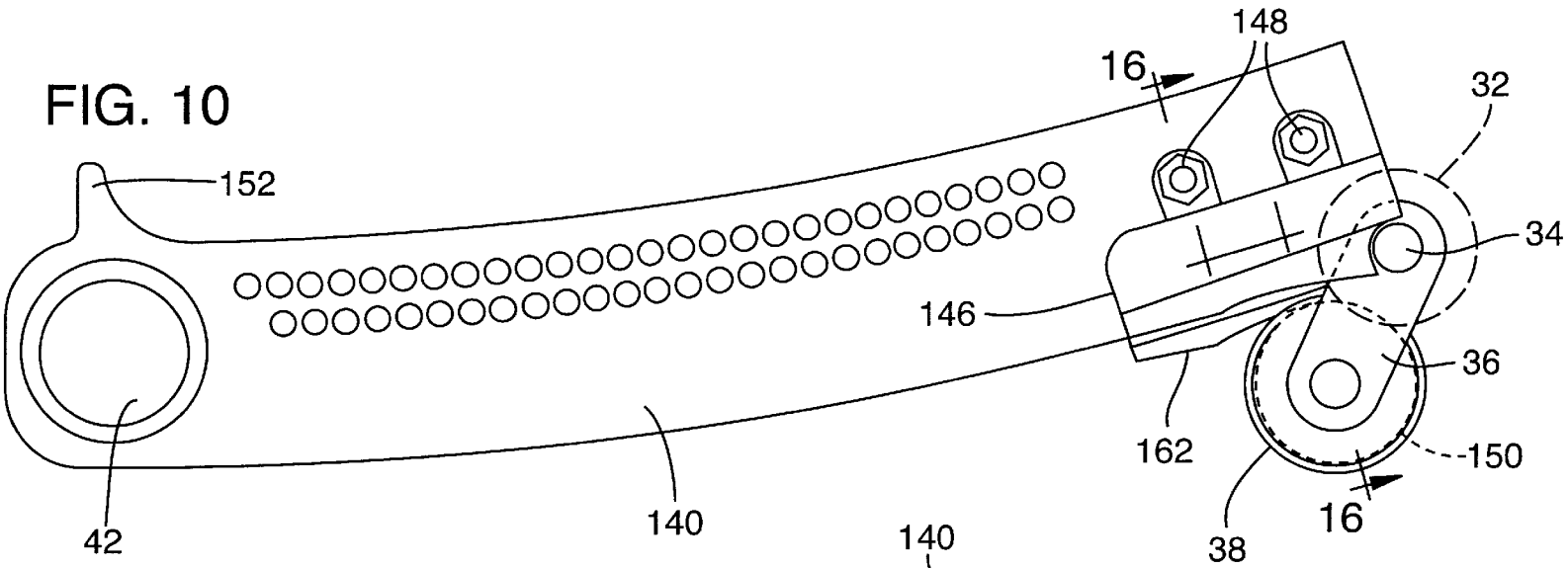
FIGS. 10–18 illustrate the working components of FIG. 9 in greater detail.
Figure 15:
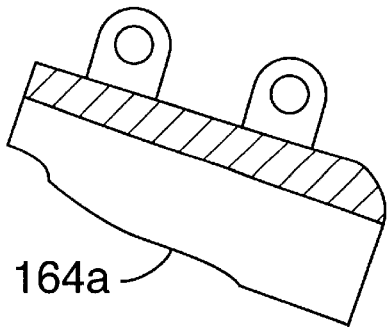
Figures 17, 18:
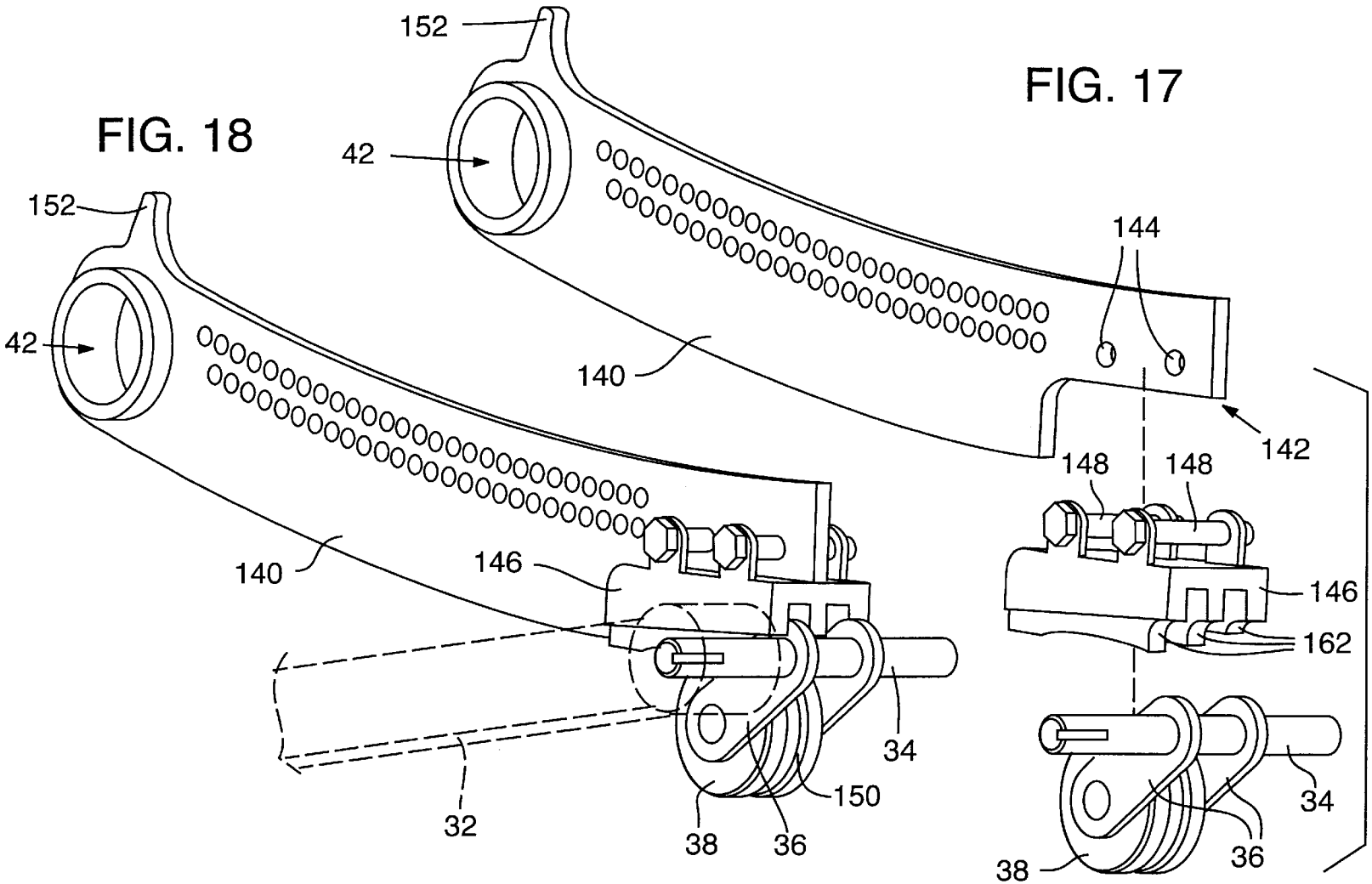

As illustrated in FIG. 17, the carriage 146 is centrally mounted relative to bar 140 and the center segment 162 engages roller 38. The carriage is prevented from undesired lateral movement due to the downward pressure exerted by the spring member 44 on bar 140 which urges the selected cam surface into groove 150 in roller 38. (See FIG. 9) Whereas bar 140 and roller 38 are laterally fixed, the shifting of carriage 146 is enabled by first moving spring member 44 back toward pivot 42, i.e., against stop 152, which permits the user to pivotally lift bar 140 off roller 38 and simply slide carriage 146 to the desired position. FIGS. 9 and 15 illustrate carriage 146 moved to one of the side positions with cam surface 164*c* engaging groove 150.

Carriage 146 and its cam surfaces 164*a*, 164*b* and 164*c* are further illustrated in FIGS. 10–14. Cam surface 164*a* is configured to provide substantially constant resistance, 164*b* provides increasing resistance and 164*c* provides decreasing and then increasing resistance. These are but a few examples of what may be provided.

This invention is very attractive because of the various "shaped" resistances from which a user can select, and also because this selection is simply accomplished by the user making a minor adjustment, without having to modify the machine. As briefly explained, if the user decides he wants to simulate a constant lift resistance as provided by cam surface 164*a*, he simply moves the spring member 44 all the way back to engage stop 152 and then lifts bar 140 off roller 38. This allows free sliding of the carriage 146 and he simply slides the desired cam surface into alignment with roller 38 and lowers the bar 140. Moving spring member 44 outwardly from stop 152 assures the continued engagement of the selected cam surface with roller 38.

Instead of sliding a shift carriage to select the desired resistance "shape," replaceable single blades could be used to make the appropriate selection. The replaceable blades can engage the desired cam surface (164*a,* 164*b* or 164*c*) to lift roller 38, each cam surface representing a different resistance "shape" that the user experiences. Another substitute for the shift carriage is a rotary lock mechanism that can be rotated to different positions to engage the selected cam surface to lift roller 38.

A further option that can be made available to the user is a replacement of pivot arm 36. Such is not illustrated but is explained as follows: By providing a longer or shorter arm 36, the resistance felt by the user correspondingly increases or decreases. It is furthermore contemplated that a shift carriage somewhat on the order of the shift carriage 146 can be provided to enable rapid interchange of such pivot arms 36.

Yet another option that could be employed to obtain different "shaped" resistances is to allow the user to alter the point of pivot of lift arm 32. Any movement of said pivot arm would have a corresponding change on the "shape" of the resistance. However, this option would require a moderately more complex adjustment because axle 34 would have to be separated from lift arm 32 before the adjustment could be made.

Whereas the above embodiments involve the use of cable and pulley connections, i.e., cable 31 and pulley 30, it is contemplated that the connections can be provided by other means, e.g., gears. An example is illustrated in FIGS. 19–22.

Figure 19:
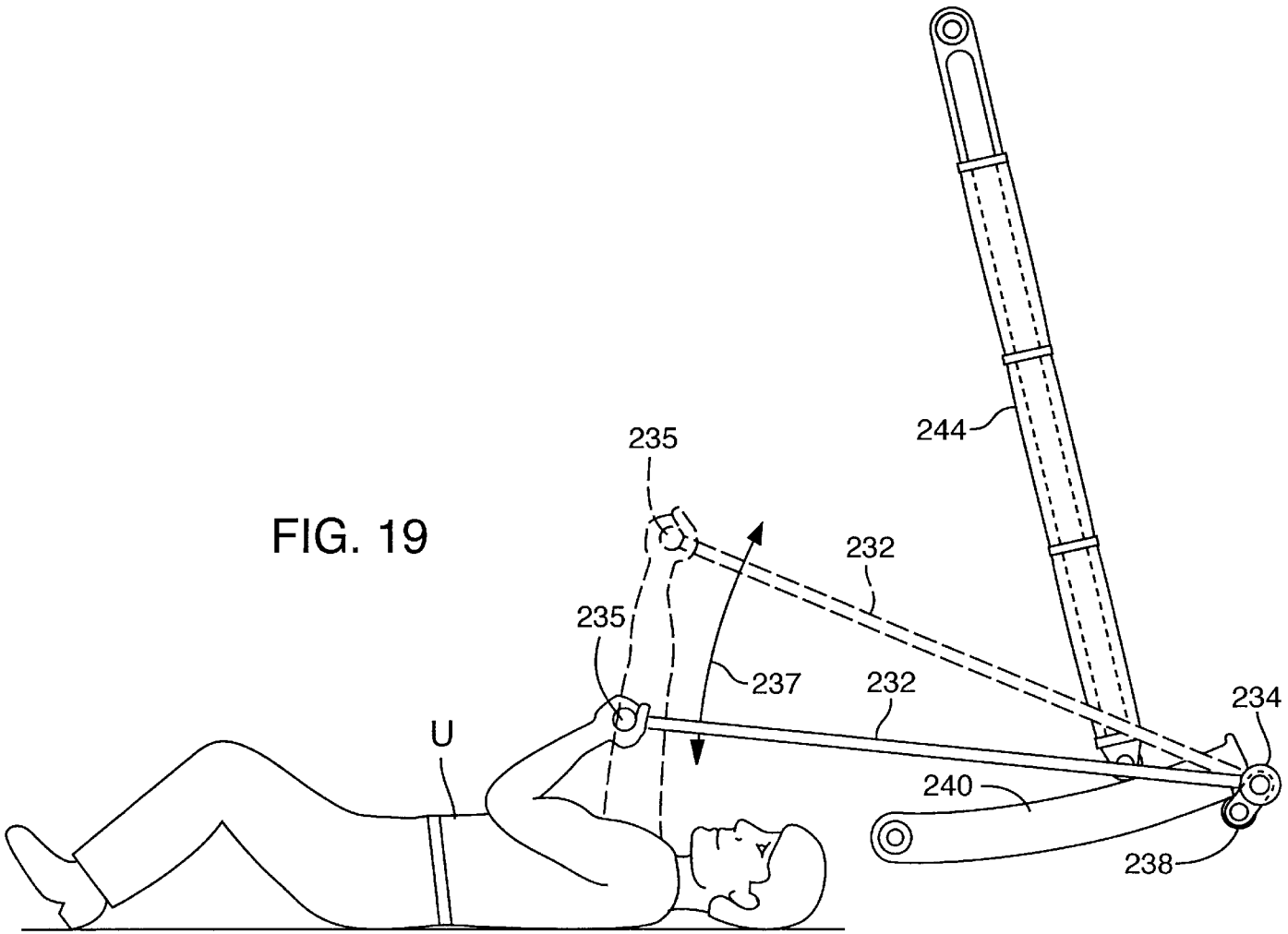
FIGS. 19–23 illustrate further embodiments of the invention.

Reference is now made to FIG. 19 which illustrates a first alternate embodiment. Lever arm 232 is mounted at axle 234. The distal end of arm 232 is extended forward and fitted, e.g., with lifting grips 235 and a user U raises and lowers the arm end as indicated by arrows 237. A pivot arm 236 is fitted to the same axle 234 (in a manner similar to the previous embodiment) and pivotal movement of lifting arm 232 generates pivoting of pivot arm 236 whereby roller 238 at the distal end of arm 236 engages and raises bar 240. Raising bar 240 (around pivot 234) produces compression of spring member 244. Spring member 244 is adjustable along bar 240 in the manner explained for the previous embodiments.

Figure 20:
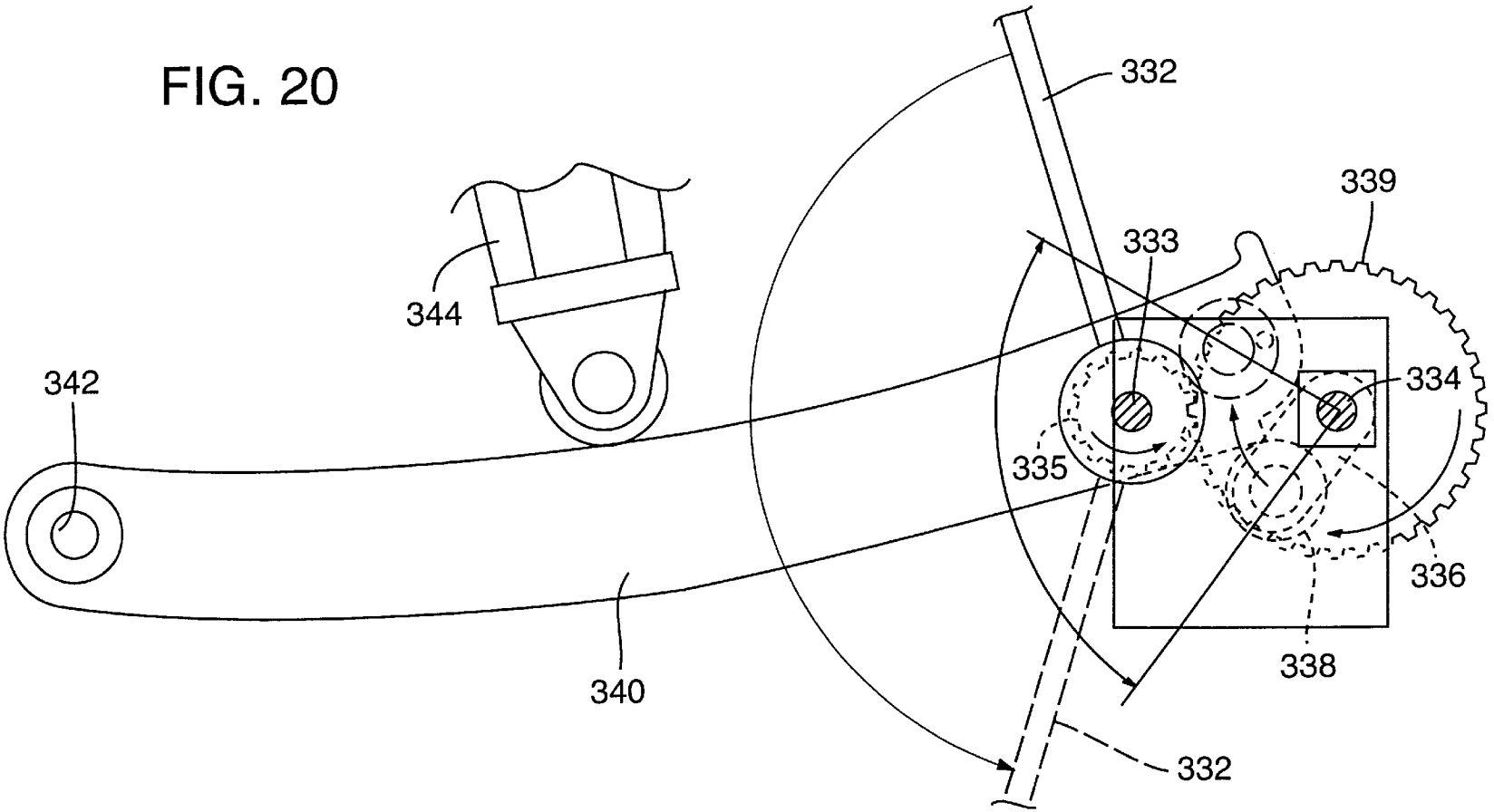
Figure 22:
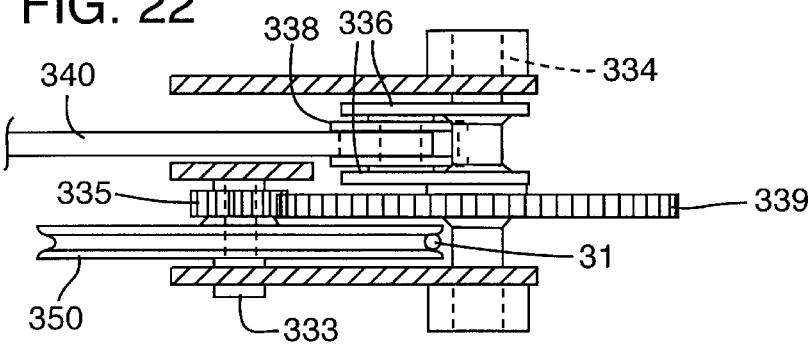

FIG. 20 shows a modification of the embodiment of FIG. 19. In FIG. 20, the lifting arm 332 is pivotally secured to a separate pivot 333 which carries gear 335. A larger gear 339 is secured to axle 334. Gear teeth of gear 339 are engaged with gear teeth of gear 335 and pivotal movement of lifting arm 332 forces rotation of gear 339 and axle 334 but reduced by the gear reduction relationship of gears 335 and 339. Pivot arm 336 is secured to axle 334 and roller 338 engages bar 340 to force pivoting of bar 340 around pivot 342. Spring member 344 is accordingly compressed (corresponding to the pivot of roller 338) as in the manner of the prior embodiment. It will furthermore be appreciated that lift arm 332 may be directly manipulated by a user as in FIG. 19 or it may be connected to cables as in FIG. 6.

Figure 21:
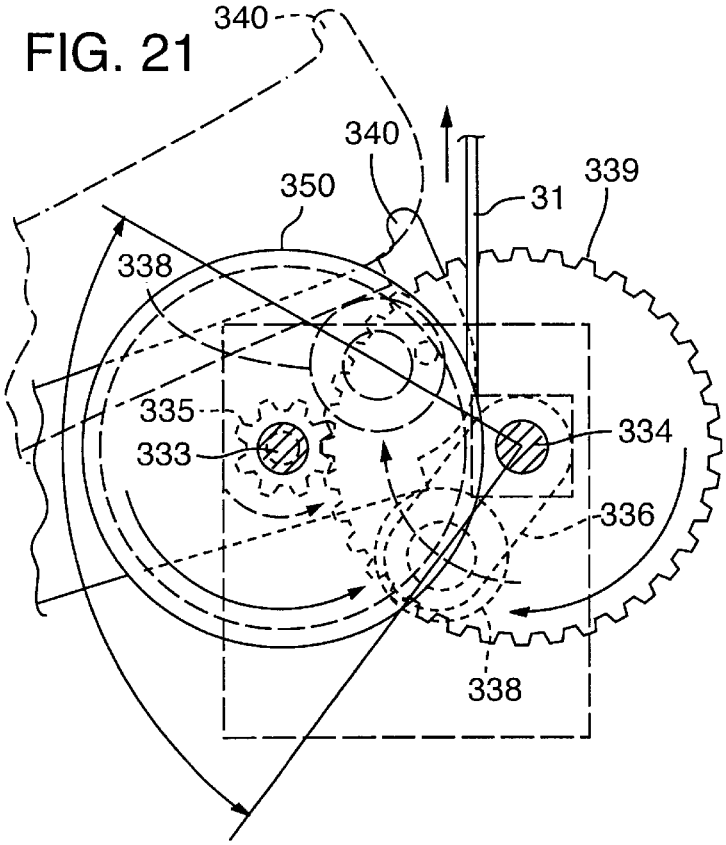
Figure 23:
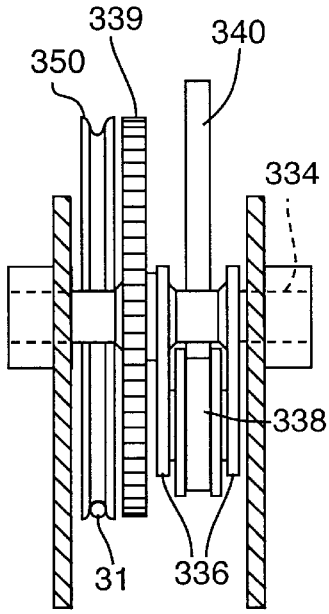

FIG. 21 is a further modification of the embodiment of FIG. 20. The lift arm 332 of FIG. 20 is replaced with pulley 350 mounted to pivot 333 and gear 335 is secured to pulley and/or pivot 333. As in FIG. 20 the teeth of gear 335 force rotation of gear 339 and pivot arm 336 to raise and lower bar 340. The pulley 350 is connected to a cable, e.g., cable 31. (See also FIG. 6).

The above alternate embodiments and modifications are but examples of the many changes that can be made to the structure without departing from the intended scope of the invention, the primary objective being the control of transmitted resistance from a spring (having, e.g., an increasing resistive force) to the user U of an exercise machine. Accordingly, the invention is not to be limited to the illustrated embodiments but instead is intended to apply to a broadly interpreted scope of the claims as appended hereto.

The invention claimed is:

1. An exercising machine for a user comprising:

a support frame;

a bar pivotally connected to the frame and defining a bar pivot;

exercising paraphernalia;

interconnecting mechanism connecting said bar to said exercising paraphernalia whereby user movement of the paraphernalia produces pivoting of said bar;

a spring member engaging said bar and resisting pivotal movement of said bar through resisted deflection of the spring member, said spring member inherently providing increased resistance as the spring member is increasingly deflected; and a coupling arrangement forming at least a part of said interconnecting mechanism, said coupling arrangement including a pivot arm in sliding abutment with said bar and pivoted by said user movement to produce a changing lever advantage as the bar is pivoted to thereby counter the increasing resistance of the spring member.

2. An exercising machine for a user comprising:

a support frame;

a bar pivotally connected to the frame and defining a bar pivot;

exercising paraphernalia;

interconnecting mechanism connecting said bar to said exercising paraphernalia whereby user movement of the paraphernalia produces pivoting of said bar;

a spring member engaging said bar and resisting pivotal movement of said bar through resisted deflection of the spring member, said spring member inherently providing increased resistance as the spring member is increasingly deflected; and a coupling arrangement forming at least a part of said interconnecting mechanism, said coupling arrangement configured to produce a changing lever advantage as the bar is pivoted to thereby counter the increasing resistance of the spring member;

said spring member includes an elastomer cylinder having opposed ends, one end connected to said frame and the other end engaging the bar and compressed between the frame and bar as a result of pivotal movement of the bar.

3. An exercising machine as defined in claim 2 wherein said elastomer cylinder is confined in a telescoping tube, said cylinder pre-compressed with said tube fully extended whereat the bar is in a relaxed state allowing the opposed end of the tube to be movable along the bar length to alter the lever advantage of the spring resistance.

4. An exercising machine as defined in claim 3 including a lock member for locking and unlocking said opposed end of the tube at a selected position along the bar length.

5. An exercising machine for a user comprising:

a support frame;

a bar pivotally connected to the frame and defining a bar pivot;

exercising paraphernalia;

interconnecting mechanism connecting said bar to said exercising paraphernalia whereby user movement of the paraphernalia produces pivoting of said bar;

a spring member engaging said bar and resisting pivotal movement of said bar through resisted deflection of the spring member, said spring member inherently providing increased resistance as the spring member is increasingly deflected; and a coupling arrangement forming at least a part of said interconnecting mechanism, said coupling arrangement configured to produce a changing lever advantage as the bar is pivoted to thereby counter the increasing resistance of the spring member;

said interconnecting mechanism includes a lift arm pivotally mounted proximal to the distal end of said bar, a cable at least in part connecting the distal end of said lift arm to the paraphernalia, an abutment member abutting said bar at a position spaced from the bar pivot, said abutment member carried by said lift arm to be pivoted against the bar by pivoting of said lift arm for pivoting of the bar and compressing said spring member all as a result of a user moving an exercising paraphernalia.

6. An exercising machine as defined in claim 5 wherein said abutment member as pivoted by said lift arm movingly engages said bar along a bar edge segment, said bar edge segment defining a cam edge and said cam edge and the pivotal movement of said abutment member cooperatively arranged and configured to produce at lest in part said changing lever advantage.

7. An exercising machine as defined in claim 6 wherein said edge and the pivotal movement of said abutment member are cooperatively arranged and configured to shape the resistance felt by a user throughout movement of said exercising paraphernalia.

8. An exercising machine as defined in claim 6 wherein the bar edge segment is provided by a cam edge carrier mounted to the bar, said carrier provided with multiple and differing cam edges, said carrier shiftable relative to the abutment member to place a selected one of said multiple cam edges into engagement with said abutment member.

9. An exercise machine as defined in claim 8 wherein the abutment member is a roller carried by a pivot arm and having a pivot axis pivotally connected to the lift arm axis for common pivoting of said pivot arm with pivoting of said lift arm.

10. An exercising machine for a user comprising:

a support frame;

a bar pivotally connected to the frame and defining a bar pivot;

exercising paraphernalia;

interconnecting mechanism connecting said bar to said exercising paraphernalia whereby user movement of the paraphernalia produces pivoting of said bar;

a spring member engaging said bar and resisting pivotal movement of said bar through resisted deflection of the spring member, said spring member inherently providing increased resistance as the spring member is increasingly deflected;

a coupling arrangement forming at least a part of said interconnecting mechanism, said coupling arrangement configured to produce a changing lever advantage as the bar is pivoted to thereby counter the increasing resistance of the spring member;

the coupling arrangement includes a first gear having gear teeth and axially mounted proximal to the distal end of the bar and defining a gear axis, an abutment member carried by the gear spaced from the gear axis and in abutment with the bar, and an actuator operable by a user to actuate rotation of the first gear to force the abutment member against the bar.

11. An exercising machine as defined in claim 10 wherein said actuator is a lever secured to said first gear, said lever being extended to a user location for engagement by a user for direct pivoting of the lever.

12. An exercising machine as defined in claim 11 wherein a second gear having gear teeth engages the gear teeth of the first gear, said lever connected to said second gear to pivot said second gear and accordingly the first gear, said first and second gears having a gear reduction relation.

13. An exercising machine as defined in claim 10 wherein the actuator is a pulley having a cable wound around the pulley and connected to said exercising paraphernalia, a second gear in engagement with said first gear, said pulley and second gear having coaxial and fixed relation whereby rotation of the pulley produces rotation of the second gear.

14. An exercising machine comprising:

a cable and cable guide arrangement for cable pull by a user desiring to exercise, the cable pull by the user defining a first direction of cable pull;

a pivotal bar and a compressible spring member engageable with the bar and inherently providing increased resistance as compression of the spring increases;

a coupling arrangement coupling the spring member to the cable, said coupling arrangement including a pivot arm pivoted by the cable pull and as pivoted slidably engaging the bar to urge the bar in a direction opposite the spring member, said slidable engagement changing the lever advantage to counter the increasing resistance of the spring member.

15. An exercising machine as defined in claim 14 wherein said slideable engagement defines a removable bar segment that is replaceable to enable a user to shape the resistance to cable pull felt by a user.

16. An exercising machine as defined in claim 14 wherein said compression spring is adjustable along the length of the bar to change lever arm advantage of the spring member resistance.

17. An exercising machine as defined in claim 16 wherein a pivot arm having a pivot axis is pivotally urged by the cable pull, a distal end of said pivot arm applying a lifting force against the bar when pivoted by said cable pull that changes the direction of applied force as the pivot arm is pivoted to increase leverage of the cable pull and thereby oppose increased resistance of the spring member.

18. An exercising machine as defined in claim 17 wherein the pivot arm engagement of the bar moves along a bar edge during pivoting of the pivot arm and defines an engagement section of the bar, said engagement section having a plurality of differing and interchangeable engagement sections and shift mechanism shifting a selected one of said engagement sections into engagement with the pivot arm for selective resistance to cable pull as felt by the user.

19. An exercising machine for a user comprising:

a support frame;

a bar pivotally connected to the frame and defining a bar pivot;

exercising paraphernalia;

interconnecting mechanism connecting said bar to said exercising paraphernalia whereby user movement of the paraphernalia produces pivoting of said bar;

a spring member engaging said bar and resisting pivotal movement of said bar through resisted deflection of the spring member, said spring member inherently providing increased resistance as the spring member is increasingly deflected; and a coupling arrangement forming at least a part of said interconnecting mechanism, said coupling arrangement including a pivot arm having sliding engagement with said bar to produce a changing lever advantage as the bar is pivoted, such that the resistive force experienced by the user increases as said bar pivots during said movement of the exercising paraphernalia.

20. An exercising machine for a user comprising:

a support frame;

a bar pivotally connected to the frame and defining a bar pivot;

exercising paraphernalia;

interconnecting mechanism connecting said bar to said exercising paraphernalia whereby user movement of the paraphernalia produces pivoting of said bar;

a spring member engaging said bar and resisting pivotal movement of said bar through resisted deflection of the spring member, said spring member inherently providing increased resistance as the spring member is increasingly deflected; and a coupling arrangement forming at least a part of said interconnecting mechanism; said coupling arrangement including a pivot arm slidably engaging the bar to produce a changing lever advantage as the bar is pivoted, such that the resistive force experienced by the user decreases as said bar pivots during said movement of the exercising paraphernalia.

* * * * *